United States Patent [19]

Wakita et al.

[11] Patent Number: 4,950,340

[45] Date of Patent: Aug. 21, 1990

[54] INTERMETALLIC COMPOUND TYPE ALLOY HAVING IMPROVED TOUGHNESS MACHINABILITY AND WEAR RESISTANCE

[75] Inventors: Saburo Wakita, Noda; Junji Hoshi, Ohmiya, both of Japan

[73] Assignee: Mitsubishi Kinzoku Kabushiki Kaisha, Tokyo, Japan

[21] Appl. No.: 229,019

[22] Filed: Aug. 5, 1988

[30] Foreign Application Priority Data

| | | | |
|---|---|---|---|
| Aug. 10, 1987 | [JP] | Japan | 62-199275 |
| Aug. 10, 1987 | [JP] | Japan | 62-199276 |
| Aug. 10, 1987 | [JP] | Japan | 62-199277 |
| Aug. 11, 1987 | [JP] | Japan | 62-200575 |
| Aug. 11, 1987 | [JP] | Japan | 62-200576 |

[51] Int. Cl.[5] ..... C22C 19/00

[52] U.S. Cl. ..... 148/402; 148/425; 148/426; 148/427; 148/442

[58] Field of Search ..... 148/402, 425, 426, 427, 148/442

[56] References Cited

U.S. PATENT DOCUMENTS 4,144,057 3/1979 Melton et al. ..... 148/402

*Primary Examiner*—R. Dean

*Attorney, Agent, or Firm*—Fitch, Even, Tabin & Flannery

[57] ABSTRACT

An intermetallic compound type alloy consisting essentially of:

Ni or Co or both 45–60%;

Si 0.01–1%;

Re 0–2%;

Hf 0–2%;

C 0–2%;

one or more elements selected from a group consisting of Zr, Fe, V, Nb, Ta, Cr, Mo, W and Mn 0–5%;

one or more elements selected from a group consisting of P, Cu, Zn, Ga, Ge, Cd, In, Sn, Sb, Pb and Bi 0–2%; and the balance Ti and incidental impurities, and having excellent toughness, machinability and wear resistance, the % being atomic %.

8 Claims, No Drawings

INTERMETALLIC COMPOUND TYPE ALLOY HAVING IMPROVED TOUGHNESS MACHINABILITY AND WEAR RESISTANCE

FIELD OF THE INVENTION

The present invention relates to an intermetallic compound type alloy having improved toughness, machinability and wear resistance and suitable for making metallic molds for forming a depolarizing mixture for dry cells, dies for drawing optical fibers and the likes, and miscelleneous wear resistant metallic articles, such as valve parts and pump parts.

BACKGROUND OF THE INVENTION

Various metallic articles to be used under abrasive conditions have conventionally been made of intermetallic compound type alloys comprising Ni and/or Co 45–60 atomic % and the remainder Ti and incidental impurities.

Such intermetallic compound type alloys exhibit excellent wear resistance and other mechanical properties for long periods of time, but they are difficult to be machined, especially bored, due to their poor machinability. Therefore, skilful art and much time are necessary to machine the alloy into complicated shapes and such poor machinability increases the cost of production of machined articles.

Additionally, the conventional intermetallic compound type alloys described above tend to absorb oxygen due to high Ti content. As the Ti content increases in the alloy, the embrittlement of the alloy proceeds rapidly to often cause flaws and cracks therein while machined. The alloys, therefore, must be melted and cast in vacuum or in an inert gas atmosphere fully excluding air, not to cause such defects. On the other hand, the raw materials to be melted are desirably of the smallest oxygen content, but some of the commercially available Ti-bearing raw materials often contain more than 500–1,500 ppm of oxygen. The use of such high oxygen Ti-bearing materials inevitably causes a high oxygen content of up to even 1,200–2,000 ppm in the resultant alloy even if the raw materials are melted and cast in vacuum or in an inert gas atmosphere. Such a high oxygen alloy can not be applied to practical use except as scrap due to its extremely low toughness which makes it impossible to be machined.

SUMMARY OF THE INVENTION

The present invention relates to a novel intermetallic compound type alloy having improved toughness, machinability and wear resistance over conventional alloys. The alloy of the present invention comprises Ni and/or Co 45–60% Si 0.01–1%, Re 0–2%, Hf 0–2%, C 0–2%, one or more elements selected from a group consisting of Zr, Fe, V, Nb, Ta, Cr, Mo, W and Mn 0–5%, one or more elements selected from a group consisting of P, Cu, Zn, Ga, Ge, Cd, In, Sn, Sb, Pb and Bi 0–2%, and the remainder Ti and incidental impurities. (The expression of % is atomic %.)

DETAILED DESCRIPTION OF THE INVENTION

We, the inventors, have conducted research to improve various physical properties of the conventional intermetallic compound type alloy described above, and obtained many findings on the effects of alloying elements.

First, Si contained in the alloy remarkably improves the toughness without any reduction of the inherent excellent wear resistance. One or more elements selected from a group consisting of P, Cu, Zn, Ga, Cd, In, Sn, Sb, Pb and Bi (these elements are hereinafter designated as toughness improving constituents) contained in the alloy further improve the toughness.

Second, where C is incorporated with the alloy together with Si, the wear resistance of the alloy is much increased without occurrence of any embrittlement of the alloy. Where one or more elements selected from a group consisting of Zr, Fe, V, Nb, Ta, Cr, Mo, W and Mn (these elements are hereinafter designated as wear resistance improving constituents) are incorporated with the alloy, the wear resistance is further improved.

Third, if Re is contained in the alloy, the alloy exhibits excellent machinability without any decrease of the inherent excellent wear resistance. Re also brings out the toughness in the alloy since Re reacts with oxygen having been dissolved in the alloy matrix thereby to remove or diminish the oxygen content in the alloy.

The addition of Hf is also effective to improve further the machinability of the resultant alloy.

Contents of above-mentioned alloying elements are defined in the following ranges according to the technical reasons described hereinafter.

(a) Ni and Co

Both elements combine with Ti to form intermetallic compounds which are effective to increase remarkably the wear resistance of the resultant alloy. If the content of Ni and/or Co is not more than 45%, the Ti amount becomes relatively excessive in the intermetallic compound thus formed and accordingly the expected level of wear resistance can not be obtained. On the contrary, if Ni and/or Co content exceeds 60%, the Ti amount becomes relatively insufficient in forming the intermetallic compound and embrittlement of the alloy proceeds whereby the expected level of wear resistance can not be obtained. Accordingly, the preferable content of Ni and/or Co is defined in the range of 45–60%. The more preferable range has turned out to be 47–53%.

(b) Si

Si incorporated with the alloy improves the toughness thereof without any deterioration in either the inherent excellent wear resistance or machinability already having been brought out by an incorporation of Re and Hf as hereinafter described. Where the Si content is less than 0.01%, toughness can not be attained to the desired level, and where the Si content is more than 1%, the alloy has a tendency to become brittle. Accordingly, the preferable Si content is defined between 0.01% and 1%.

(c) toughness improving constituents (P, Cu, Zn, Ga, Ge, Cd, In, Sn, Sb, Pb, Bi)

If the sum of the amounts of these elements are not more than 0.1%, the resultant alloy cannot maintain the toughness desired. On the other hand, when amounts of these elements exceed 2%, the resultant alloy tends to be brittle. Therefore, the amounts of toughness improving constituents are defined in a preferable range of 0.1–2%.

(d) C

C much improves the wear resistance of the alloy without causing embrittlement, if contained in the alloy together with Si, as described above. Less than 0.05% of C is not sufficient to exhibit the desired wear resistance, whereas more than 2% of C brings out embrittlement of the alloy. Therefore, the preferable C content is defined between 0.05% and 2%.

(e) wear resistance improving constituents (Zr, Fe, V, Nb, Ta, Cr, Mo, W, Mn)

If the sum of the amounts of these elements are less than 0.1% in the alloy, the expected wear resistance improving effect cannot be obtained, whereas more than 5% of the sum of the amounts of these constituents embrittle the alloy structure and lower the toughness thereof. Therefore, the preferable content of the sum of the amounts of these elements is defined in a range of 0.1–3%. The more preferable range is 0.1–3%.

(f) Re

Re improves not only the machinability of the alloy but also the toughness thereof since Re combines with oxygen dissolved in the alloy matrix and serves to remove oxygen, as explained above. If the Re content is not more than 0.05%, the desired effects are not achieved, whereas when the Re content exceeds 2%, the alloy tends to be brittle. Therefore, the preferable range of the Re content is 0.05–2%.

(g) Hf

Hf incorporated with the alloy together with Re improves the machinability of the alloy without any reduction of the inherent excellent wear resistance, as mentioned above. If amounts of Hf are less than 0.1%, machinability cannot be maintained at the desired level. On the contrary, if the Hf content exceeds 2%, embrittlement is observed in the alloy structure. Threrefore, the preferable Hf content range is 0.1–2%.

Now some examples of the present invention will be explained in detail.

EXAMPLE 1

A group of alloys having the compositions shown in Table 1 were melted in a plasma arc furnace and the melts were cast into ingots. The obtained ingots were remelted in an arc furnace and the resultant melts were cast centrifugally into precise ceramic molds. Then the castings were surface ground to obtain Charpy V-notch impact test specimens, Nos. 1 through 22 for alloys of the present invention and Nos. 1 through 8 for the conventional alloys, each having 10 mm square cross sectional area and 50 mm length.

The resultant test specimens Nos. 1 through 22 for the present invention and the other test specimens Nos. 1 through 8 for the conventional alloys were subjected to the Vickers hardness test for estimating the wear resistance and also to the Charpy V-notch impact test for estimating the toughness. The test results are shown in the Table 1.

TABLE 1

| | | Alloy compositions (atomic %) | | | | | | |
|---|---|---|---|---|---|---|---|---|
| | | Ni | Co | Si | Wear resistance improving constituents | Ti + impurities | Vickers hardness | Charpy impact value (kg · m) |
| Alloy of this invention | 1 | 45.6 | — | 0.55 | — | Bal. | 267 | 0.08 |
| | 2 | 50.7 | — | 0.50 | — | " | 373 | 0.07 |
| | 3 | 59.3 | — | 0.45 | — | " | 450 | 0.07 |
| | 4 | — | 46.0 | 0.45 | — | " | 315 | 0.08 |
| | 5 | — | 51.2 | 0.60 | — | " | 361 | 0.07 |
| | 6 | — | 58.7 | 0.55 | — | " | 464 | 0.06 |
| | 7 | 26.4 | 24.4 | 0.50 | — | " | 302 | 0.11 |
| | 8 | 51.3 | — | 0.60 | — | " | 289 | 0.08 |
| | 9 | 50.7 | — | 0.97 | — | " | 281 | 0.09 |
| | 10 | 26.2 | 24.7 | 0.35 | Zr:0.2 | " | 358 | 0.10 |
| | 11 | 24.4 | 24.5 | 0.25 | Fe:1.5 | " | 362 | 0.09 |
| | 12 | 48.4 | — | 0.55 | V:1.3 | " | 386 | 0.08 |
| | 13 | 44.0 | 5.5 | 0.41 | Nb:0.6 | " | 422 | 0.08 |
| | 14 | 25.0 | 24.3 | 0.30 | Ta:0.9 | " | 419 | 0.09 |
| | 15 | — | 48.0 | 0.45 | Cr:2.2 | " | 389 | 0.07 |
| | 16 | 25.1 | 24.4 | 0.24 | Mo:1.2 | " | 414 | 0.12 |
| | 17 | 25.0 | 21.3 | 0.05 | W:4.5 | " | 485 | 0.15 |
| | 18 | 49.2 | — | 0.45 | Mn:1.7 | " | 363 | 0.07 |
| | 19 | 25.9 | 23.4 | 0.60 | Zr:0.2, Ta:0.7 | " | 452 | 0.14 |
| | 20 | 21.7 | 25.5 | 0.30 | V:0.5, Cr:2.3 | " | 489 | 0.11 |
| | 21 | — | 48.3 | 0.35 | Fe:0.3, Nb:0.5, Mo:1.0 | " | 521 | 0.07 |
| | 22 | 23.3 | 23.0 | 0.82 | Zr:0.2, Fe:0.2 Cr:1.1, W:1.7 | " | 513 | 0.13 |
| Conventional alloys | 1 | 46.1 | — | — | — | " | 265 | 0.04 |
| | 2 | 52.6 | — | — | — | " | 381 | 0.01 |
| | 3 | 59.4 | — | — | — | " | 456 | 0.01 |
| | 4 | — | 47.0 | — | — | " | 311 | 0.03 |
| | 5 | — | 52.1 | — | — | " | 363 | 0.01 |
| | 6 | — | 59.1 | — | — | " | 462 | 0.01 |
| | 7 | 25.6 | 24.7 | — | Mo:1.4, Fe:0.2 | " | 399 | 0.02 |
| | 8 | 49.1 | 7.2 | — | — | " | 477 | 0.01 |

It will be apparent from Table 1 that alloy specimens Nos. 1 through 22 of the present invention exhibit high hardness (relating to wear resistance) compared to that of conventional alloy specimens Nos. 1 through 8, and also exhibit toughness much higher than that of the conventional alloy specimens.

EXAMPLE 2

A group of alloys having the compositions shown in Table 2 were melted in a plasma arc furnace and the melts were cast into ingots. The obtained ingots were remelted in an arc furnace and the resultant melts were cast centrifugally into precise ceramic molds. Then the castings were surface ground to obtain Charpy V-notch impact test specimens, Nos. 23 through 38 for alloys of the present invention and Nos. 1 through 8 for the conventional alloys, each having 10 mm square cross sectional area and 50 mm length.

The resultant test specimens Nos. 23 through 38 for the present invention and the other test specimens Nos. 1 through 8 for the conventional alloys were subjected to the Vickers hardness test for estimating wear resistance and also to the Charpy V-notch impact test for estimating toughness. The test results are shown in Table 2.

TABLE 2

| | | Alloy composition (atomic %) | | | | | | | Charpy impact value (kg · m) |
|---|---|---|---|---|---|---|---|---|---|
| | | Ni | Co | Si | Toughness improving constituents | Wear resistance improving constituents | Ti + impurities | Vickers hardness | |
| Alloy of this Invention | 23 | 45.3 | — | 0.55 | P:0.21 | — | Bal. | 271 | 0.09 |
| | 24 | 51.4 | — | 0.49 | P:0.14, In:0.11 | — | " | 359 | 0.09 |
| | 25 | 59.5 | — | 0.61 | Cu:1.40, Cd:0.32 | — | " | 415 | 0.08 |
| | 26 | — | 45.8 | 0.43 | Cd:1.07 | — | " | 308 | 0.10 |
| | 27 | — | 52.1 | 0.56 | P:0.12, Zn:0.14 Ga:0.11 | — | " | 343 | 0.08 |
| | 28 | — | 59.5 | 0.58 | Sn:1.90 | — | " | 482 | 0.07 |
| | 29 | 24.6 | 26.3 | 0.30 | P:0.15 | — | " | 325 | 0.12 |
| | 30 | 24.7 | 25.1 | 0.06 | Bi:0.14 | — | " | 359 | 0.10 |
| | 31 | 24.6 | 26.2 | 0.98 | Cu:0.31, Zn:0.06, Cd:0.08, In:0.04 Pb:0.07 | — | " | 391 | 0.08 |
| | 32 | — | 49.5 | 0.22 | In:0.19 | Zr:1.3 | " | 401 | 0.08 |
| | 33 | 22.6 | 26.4 | 0.25 | Cu:0.31, Pb:0.12 | Cr:2.7 | " | 422 | 0.09 |
| | 34 | 24.2 | 23.0 | 0.33 | P:0.16, Cu:0.27 Zn:0.14 | Nb:3.2 | " | 438 | 0.08 |
| | 35 | 24.5 | 21.4 | 0.25 | Cu:0.32, Sb:0.12 | V:0.2, Ta:0.3 | " | 481 | 0.07 |
| | 36 | 20.8 | 24.2 | 0.03 | Zn:0.18, Ge:0.12 | W:4.9 | " | 439 | 0.07 |
| | 37 | 43.0 | — | 0.16 | P:0.11, Bi:0.13 | Zr:0.9, Ta:0.5 Mo:2.4, W:0.6 | " | 502 | 0.07 |
| | 38 | 20.6 | 20.9 | 0.28 | Cu:0.12, Ga:0.08 Cd:0.04, Pb:0.04 | Fe:0.8, V:1.6 Nb:0.6, Cr:0.8 Mn:0.4 | " | 455 | 0.08 |
| Conventional alloys | 1 | 46.1 | — | — | — | — | " | 265 | 0.04 |
| | 2 | 52.6 | — | — | — | — | " | 381 | 0.01 |
| | 3 | 59.4 | — | — | — | — | " | 456 | 0.01 |
| | 4 | — | 47.0 | — | — | — | " | 311 | 0.03 |
| | 5 | — | 52.1 | — | — | — | " | 363 | 0.01 |
| | 6 | — | 59.1 | — | — | — | " | 462 | 0.01 |
| | 7 | 25.6 | 24.7 | — | — | Mo:1.4, Fe:0.2 | " | 399 | 0.02 |
| | 8 | 49.1 | 7.2 | — | — | — | " | 477 | 0.01 |

It will be apparent from Table 2 that alloy specimens Nos. 23 through 38 of the present invention exhibit high hardness (relating to wear resistance) compared to that of conventional alloy specimens Nos. 1 through 8, and also exhibit toughness much higher than that of the conventional alloy specimens.

EXAMPLE 3

A group of alloys having the compositions shown in Table 3 were melted in a plasma arc furnace and the melts were cast into ingots. The obtained ingots were remelted in an arc furnace and the resultant melts were cast centrifugally into precise ceramic molds. Then the castings were surface ground to obtain Charpy V-notch impact test specimens, Nos. 39 through 60 for alloys of the present invention and Nos. 9 through 16 for the conventional alloys, each having 10 mm square cross sectional area and 50 mm length.

The resultant test specimens Nos. 39 through 60 for the present invention and the other test specimens Nos. 9 through 16 for the conventional alloys were subjected to the Vickers hardness test for estimating wear resistance and also to the Charpy V-notch impact test for estimating toughness. The test results are shown in Table 3.

TABLE 3

| | | Alloy compositions (atomic %) | | | | | | | Charpy impact value (kg · m) |
|---|---|---|---|---|---|---|---|---|---|
| | | Ni | Co | Si | C | Wear resistance improving constituents | Ti + impurities | Vickers hardness | |
| Alloys of this Invention | 39 | 45.1 | — | 0.25 | 1.0 | — | Bal. | 304 | 0.09 |
| | 40 | 50.3 | — | 0.50 | 1.0 | — | " | 351 | 0.08 |
| | 41 | 59.4 | — | 0.21 | 0.9 | — | " | 458 | 0.08 |
| | 42 | — | 47.0 | 0.05 | 0.9 | — | " | 311 | 0.09 |
| | 43 | — | 51.4 | 0.92 | 1.0 | — | " | 380 | 0.09 |
| | 44 | — | 58.2 | 0.32 | 1.1 | — | " | 463 | 0.07 |
| | 45 | 24.6 | 25.6 | 0.46 | 0.9 | — | " | 317 | 0.11 |
| | 46 | — | 50.3 | 0.49 | 1.0 | — | " | 382 | 0.09 |
| | 47 | 50.9 | — | 0.53 | 1.1 | — | " | 376 | 0.08 |
| | 49 | 51.0 | — | 0.12 | 0.053 | — | " | 418 | 0.07 |
| | 48 | 24.7 | 25.2 | 0.09 | 1.9 | — | " | 356 | 0.09 |
| | 50 | 49.9 | — | 0.62 | 1.0 | Zr:0.11 | " | 439 | 0.08 |
| | 51 | 51.1 | — | 0.47 | 1.1 | Fe:4.9 | " | 494 | 0.07 |
| | 52 | — | 50.5 | 0.29 | 1.0 | V:1.1 | " | 420 | 0.08 |

TABLE 3-continued

| | | Alloy compositions (atomic %) | | | | | | | |
|---|---|---|---|---|---|---|---|---|---|
| | | Ni | Co | Si | C | Wear resistance improving constituents | Ti + impurities | Vickers hardness | Charpy impact value (kg · m) |
| | 53 | 23.8 | 26.6 | 0.34 | 0.9 | Nb:3.0 | " | 383 | 0.09 |
| | 54 | 48.4 | — | 0.24 | 1.1 | Ta:0.6 | " | 387 | 0.09 |
| | 55 | — | 52.4 | 0.36 | 0.8 | Cr:2.0 | " | 460 | 0.08 |
| | 56 | 20.8 | 30.2 | 0.12 | 1.0 | Mo:0.2 | " | 492 | 0.08 |
| | 57 | 50.1 | — | 0.55 | 0.9 | W:4.0 | " | 503 | 0.08 |
| | 58 | 49.6 | — | 0.20 | 1.1 | Mn:2.5 | " | 428 | 0.09 |
| | 59 | — | 50.7 | 0.37 | 1.0 | Zr:2.5, Fe:1.1 | " | 495 | 0.08 |
| | 60 | 29.0 | 20.1 | 0.61 | 0.9 | V:2.0, Nb:1.0, W:0.9 | " | 481 | 0.09 |
| Conventional alloys | 9 | 45.9 | — | — | — | — | " | 261 | 0.02 |
| | 10 | 52.3 | — | — | — | — | " | 380 | 0.01 |
| | 11 | 59.1 | — | — | — | — | " | 451 | 0.01 |
| | 12 | — | 46.1 | — | — | — | " | 310 | 0.03 |
| | 13 | — | 50.1 | — | — | — | " | 357 | 0.01 |
| | 14 | — | 58.7 | — | — | — | " | 440 | 0.01 |
| | 15 | 25.1 | 25.3 | — | — | Mo:1.4, Fe:0.2 | " | 383 | 0.04 |
| | 16 | 23.1 | 26.4 | — | — | — | " | 353 | 0.03 |

It will be apparent from Table 3 that alloy specimens Nos. 39 through 60 of the present invention exhibit high hardness (relating to wear resistance) comparable with that of conventional alloy specimens Nos. 9 through 16, and also exhibit toughness much higher than that of the conventional alloy specimens.

EXAMPLE 4

A series of alloys having the compositions shown in Table 4 were melted in a plasma arc furnace and the melts were cast into ingots. The cast ingots were remelted in an arc furnace and the resultant melts were cast centrifugally into precise ceramic molds to produce a series of cast specimens of the alloys of the present invention Nos. 61 through 84 and that of the conventional alloys Nos. 17 through 20%.

Then, disc shaped test specimens, each having 10 mm diameter and 3 mm thickness, were cut out from each of the cast specimens of the alloys of the present invention Nos. 61 through 84 and those of the conventional alloys Nos. 17 through 20. The resultant test specimens were subjected to the Brinell hardness test by applying 750 kg of load on the center of each specimen disc, for measuring hardness and thereby estimating toughness. After measuring the hardness, the specimens were also inspected visually as to whether any cracks or flaws were observed or not.

The Charpy impact test was applied to further alloy specimens, each having a size of 10 mm square and 50 mm length, for estimating toughness.

A boring test was applied to further larger sized specimens of the alloys of the present invention Nos. 61 through 84 and those of the conventional alloys Nos. 17 through 20, each specimen having the size of 20 mm diameter and 5 mm thickness, using a WC bearing hard alloy drill bit having 7 mm diameter and rotated at a rotational speed of about 200 rpm. Time required for boring through the thickness of each test specimen was measured and the edge of the resultant bore was visually inspected as to whether or not any chipping had been caused. The boring test was carried out for estimating the machinability of the alloys of the present invention compared to that of the conventional alloys.

Additionally, the Vickers hardness was measured on all these alloys specimens for estimating wear resistance. All these test results are shown in Table 4.

TABLE 4

| | | Alloy compositions (atomic %) | | | | | | | | | | | |
|---|---|---|---|---|---|---|---|---|---|---|---|---|---|
| | | Ni | Co | Re | Si | Wear resistance improving constituents | Toughness improving constituents | Ti + impurities | Cracks | Time required for the boring (min) | Chipping on the bore edge | Charpy impact value (kg · m) | Vickers hardness |
| Alloys of this Invention | 61 | 46.8 | — | 1.1 | 0.5 | — | — | Bal. | not observed | 3.5 | not observed | 0.10 | 298 |
| | 62 | 52.5 | — | 1.0 | 0.4 | — | — | " | not observed | 4.1 | not observed | 0.12 | 352 |
| | 63 | — | 47.5 | 0.9 | 0.5 | — | — | " | not observed | 3.5 | not observed | 0.11 | 316 |
| | 64 | — | 52.1 | 1.0 | 0.9 | — | — | " | not observed | 4.0 | not observed | 0.12 | 377 |
| | 65 | 24.7 | 25.1 | 1.0 | 0.5 | — | — | " | not observed | 4.2 | not observed | 0.10 | 360 |
| | 66 | 23.2 | 25.9 | 0.051 | 0.4 | — | — | " | not observed | 4.9 | not observed | 0.11 | 392 |
| | 67 | 51.0 | — | 1.9 | 0.3 | — | — | " | not observed | 4.6 | not observed | 0.12 | 392 |
| | 68 | — | 48.7 | 1.1 | 0.03 | — | — | " | not observed | 4.4 | not observed | 0.09 | 358 |
| | 69 | 25.0 | 24.6 | 0.1 | 0.05 | — | — | " | not observed | 4.5 | not observed | 0.10 | 345 |
| | 70 | 23.8 | 25.1 | 0.9 | 0.4 | Zr:1.4 | — | " | not observed | 4.8 | not observed | 0.10 | 382 |
| | 71 | 49.8 | — | 1.0 | 0.5 | Fe:0.9 | — | " | not observed | 4.2 | not observed | 0.09 | 415 |
| | 72 | — | 50.2 | 0.9 | 0.6 | Mn:2.3 | — | " | not ob- | 4.7 | not ob- | 0.12 | 392 |

TABLE 4-continued

| | | Alloy compositions (atomic %) | | | | | | | | | | | |
|---|---|---|---|---|---|---|---|---|---|---|---|---|---|
| | | Ni | Co | Re | Si | Wear resistance improving constituents | Toughness improving constituents | Ti + impurities | Cracks | Time required for the boring (min) | Chipping on the bore edge | Charpy impact value (kg · m) | Vickers hardness |
| | 73 | — | 49.1 | 0.9 | 0.2 | V:1.2 | — | " | not observed | 4.6 | not observed | 0.11 | 402 |
| | 74 | 25.0 | 24.8 | 1.5 | 0.4 | Fe:1.0, Cr:0.2 Nb:0.2, Ta:0.2 | — | " | not observed | 4.3 | not observed | 0.08 | 451 |
| | 75 | 50.2 | — | 0.9 | 0.5 | W:0.2, Zr:0.2 | — | " | not observed | 4.2 | not observed | 0.09 | 463 |
| | 76 | 24.4 | 25.0 | 1.0 | 0.4 | — | P:0.2 | " | not observed | 3.6 | not observed | 0.13 | 352 |
| | 77 | — | 51.1 | 1.1 | 0.4 | — | Zn:1.4 | " | not observed | 4.1 | not observed | 0.14 | 374 |
| | 78 | 51.2 | — | 0.2 | 0.9 | — | Sn:1.3 | " | not observed | 4.4 | not observed | 0.14 | 361 |
| | 79 | — | 49.4 | 0.5 | 0.9 | — | In:0.9 | " | not observed | 4.0 | not observed | 0.12 | 354 |
| | 80 | 51.9 | — | 1.0 | 0.5 | — | P:0.2, Cu:0.5 Bi:0.3, Sb:0.2 | " | not observed | 3.8 | not observed | 0.14 | 374 |
| | 81 | 25.1 | 25.0 | 1.5 | 0.3 | | Ga:0.2, Cd:0.2 Pb:0.2, Ge:0.2 | " | not observed | 4.3 | not observed | 0.13 | 349 |
| | 82 | 49.5 | — | 1.0 | 0.6 | Zr:0.5 | Sn:0.7 | " | not observed | 4.5 | not observed | 0.13 | 382 |
| | 83 | — | 50.1 | 0.9 | 0.4 | Mn:0.8, V:0.2 | P:0.2, In:0.4 | " | not observed | 4.5 | not observed | 0.14 | 418 |
| | 84 | 24.8 | 25.0 | 1.2 | 0.5 | Cr:0.2, W:0.2 Ta:0.2 | Cu:0.3, Ge:0.2 Bi:0.2 | " | not observed | 4.6 | not observed | 0.13 | 430 |
| Conventional alloys | 17 | 50.3 | — | — | — | — | — | Bal. | Observed | 8.9 | Observed | 0.01 | 349 |
| | 18 | — | 50.5 | — | — | — | — | " | Observed | impossible to bore due to crack formation | — | 0.01 | 360 |
| | 19 | 25.0 | 25.2 | — | — | — | — | " | Observed | 6.5 | Observed | 0.01 | 359 |
| | 20 | 24.8 | 25.5 | — | — | — | — | " | Observed | impossible to bore due to crack formation | — | 0.01 | 362 |

It will be apparent from Table 4 that alloy specimens Nos. 61 through 84 of the present invention exhibit high hardness (relating to wear resistance) compared to that of conventional alloy specimens Nos. 17 through 20, and also exhibit toughness much higher than that of the conventional alloy specimens.

EXAMPLE 5

A series of alloys having the compositions shown in Table 5 were melted in a plasma arc furnace and the melts were cast into ingots. The cast ingots were remelted in an arc furnace and the resultant melts were cast centrifugally into precise ceramic molds to produce a series of cast specimens of the alloys of the present invention Nos. 85 through 108 and that of the conventional alloys Nos. 17 through 20.

Then, disc shaped test specimens, each having 10 mm diameter and 3 mm thickness were cut out from each of the cast specimens of the alloys of the present invention Nos. 85 through 108 and those of the conventional alloys Nos. 17 through 20. The resultant test specimens were subjected to the Brinell hardness test by applying 750 kg of load on the center of the each specimen disc, for measuring hardness and thereby estimating toughness. After measuring hardness, the specimens were also inspected visually as to whether any cracks or flaws were observed or not.

The Charpy impact test was applied to further alloy specimens, each having the size of 10 mm square and 50 mm length, for estimating toughness.

A boring test was applied to further larger sized specimens of the alloys of the present invention Nos. 85 through 108 and those of the conventional alloys Nos. 17 through 20, each specimen having the size of 20 mm diameter and 5 mm thickness, using a WC bearing hard alloy drill bit having 7 mm diameter and a rotational speed of about 200 rpm. Time required for boring through the thickness of each test specimen was measured and the edge of the resultant bore was visually inspected as to whether or not any chipping had been caused. The boring test was carried out for estimating the machinability of the alloys of the present invention.

Additionally, the Vickers hardness was measured on all these alloy specimens for estimating wear resistance. All these test results are shown in Table 5.

TABLE 5

| | | Alloy compositions (atomic %) | | | | | | | | | | | | |
|---|---|---|---|---|---|---|---|---|---|---|---|---|---|---|
| | | Ni | Co | Re | Hf | Si | Wear resistance improving constituents | Toughness improving constituents | Ti + impurities | Cracks | Time required for boring (min) | Chipping on the bore edge | Charpy impact values (kg · m) | Vickers hardness |
| Alloys of this invention | 85 | 46.9 | — | 1.0 | 0.9 | 0.5 | — | — | Bal. | not observed | 3.4 | not observed | 0.10 | 296 |
| | 86 | 51.8 | — | 0.9 | 1.9 | 0.4 | — | — | " | not observed | 3.9 | not observed | 0.11 | 348 |
| | 87 | — | 47.5 | 0.9 | 0.2 | 0.5 | — | — | " | not observed | 3.3 | not observed | 0.10 | 309 |
| | 88 | — | 52.0 | 1.1 | 1.0 | 0.3 | — | — | " | not observed | 4.1 | not observed | 0.11 | 370 |
| | 89 | 24.7 | 25.0 | 0.9 | 0.9 | 0.6 | — | — | " | not observed | 4.5 | not observed | 0.10 | 359 |
| | 90 | 23.0 | 24.9 | 0.053 | 0.9 | 0.4 | — | — | " | not observed | 4.6 | not observed | 0.10 | 388 |
| | 91 | 51.4 | — | 1.9 | 1.0 | 0.3 | — | — | " | not observed | 4.1 | not observed | 0.11 | 387 |
| | 92 | — | 48.8 | 1.0 | 1.1 | 0.03 | — | — | " | not observed | 3.9 | not observed | 0.11 | 391 |
| | 93 | 50.1 | — | 0.9 | 1.0 | 0.9 | — | — | " | not observed | 2.8 | not observed | 0.12 | 360 |
| | 94 | 23.9 | 24.8 | 0.9 | 0.9 | 0.4 | Zr:1.5 | — | " | not observed | 4.3 | not observed | 0.10 | 377 |
| | 95 | 48.8 | — | 1.0 | 0.9 | 0.5 | Fe:1.0 | — | " | not observed | 3.8 | not observed | 0.11 | 445 |
| | 96 | 49.1 | — | 1.1 | 0.8 | 0.4 | Mn:2.5 | — | " | not observed | 4.4 | not observed | 0.10 | 386 |
| | 97 | — | 49.0 | 0.9 | 0.9 | 0.2 | V:1.1 | — | " | not observed | 4.3 | not observed | 0.11 | 401 |
| | 98 | — | 50.5 | 0.3 | 1.0 | 0.5 | Fe:0.8<br>Nb:0.2<br>Cr:0.2<br>W:0.2 | — | " | not observed | 4.5 | not observed | 0.09 | 413 |
| | 99 | — | 52.1 | 0.8 | 0.9 | 0.5 | V:0.4<br>Ta:0.3<br>Mo:0.2<br>Zr:0.2 | — | " | not observed | 4.0 | not observed | 0.10 | 393 |
| | 100 | 24.9 | 25.4 | 1.0 | 1.2 | 0.4 | — | P:0.3 | " | not observed | 3.6 | not observed | 0.13 | 375 |
| | 101 | — | 51.8 | 0.9 | 0.9 | 0.6 | — | Zn:0.8 | " | not observed | 4.0 | not observed | 0.13 | 334 |
| | 102 | 51.7 | — | 0.2 | 0.2 | 0.9 | — | Sn:1.0 | " | not observed | 4.4 | not observed | 0.12 | 368 |
| | 103 | — | 48.9 | 0.5 | 1.0 | 0.9 | — | In:0.8 | " | not observed | 4.0 | not observed | 0.12 | 361 |
| | 104 | 51.4 | — | 1.0 | 1.8 | 0.5 | — | P:0.2<br>Cu:0.2<br>Bi:0.2<br>Sb:0.2 | " | not observed | 3.6 | not observed | 0.14 | 355 |
| | 105 | — | 49.5 | 0.9 | 0.2 | 0.07 | — | Ga:0.3<br>Cd:0.3<br>Pb:0.2<br>Ge:0.2 | " | not observed | 4.2 | not observed | 0.12 | 362 |
| | 106 | 49.8 | — | 1.0 | 0.8 | 0.6 | Zr:0.8 | Sn:0.5 | " | not observed | 4.5 | not observed | 0.13 | 385 |
| | 107 | — | 50.2 | 1.0 | 1.0 | 0.3 | Mn:0.6<br>Fe:0.2 | P:0.2<br>Ge:0.4 | " | not observed | 4.5 | not observed | 0.13 | 412 |
| | 108 | 24.8 | 24.9 | 1.0 | 0.9 | 0.5 | Cr:0.2<br>Mo:0.2<br>Ta:0.2 | Cu:0.3<br>Ga:0.2<br>Bi:0.2 | " | not observed | 4.6 | not observed | 0.13 | 425 |
| Conventional alloys | 17 | 50.3 | — | — | — | — | — | — | " | not observed | 8.9 | not observed | 0.01 | 349 |
| | 18 | — | 50.5 | — | — | — | — | — | " | not observed | Impossible to bore due to crack formation | — | 0.01 | 360 |
| | 19 | 25.0 | 25.2 | — | — | — | — | — | " | not observed | 6.5 | observed | 0.01 | 359 |
| | 20 | 25.8 | 25.5 | — | — | — | — | — | " | not observed | Impossible to bore due to crack formation | — | 0.01 | 362 |

It will be apparent from Table 5 that the alloy specimens of the present invention Nos. 85 through 108 exhibit hardness similar to or higher than those of conventional alloys Nos. 17 through 20 and also have favorable toughness and machinability properties over those of conventional alloys No. 17 through 20.

As can be seen from the foregoing examples, the alloys of the present invention have excellent toughness, machinability and wear resistance, and accordingly can be worked and machined to produce miscellaneous articles, parts and members without causing cracks or flaws. These articles, parts and members, if applied to practical use and subjected to abrasive attacks, will maintain excellent mechanical properties for long periods of time.

Although the present invention has been explained with reference to the preferred examples, it will be clearly understood to those skilled in the art that the present invention is not restricted to only such examples but many variations and combinations can be made without departing from the spirit and scope of the present invention.

What is claimed is:

1. An intermetallic compound type alloy consisting essentially of:

Ni or Co or both 45–60%;

Si 0.01–1%;

Re 0–2%;

Hf 0–2%;

C 0–2%;

one or more elements selected from a group consisting of Zr, Fe, V, Nb, Ta, Cr, Mo, W and Mn from 0–5%;

one or more elements selected from a group consisting of P, Cu, Zn, Ga, Ge, Cd, In, Sn, Sb, Pb and Bi from 0–2%; and the balance Ti and incidental impurities, and having excellent toughness, machinability and wear resistance, the % being atomic %.

2. An intermetallic compound type alloy according to claim 1, comprising Ni or Co or both comprising 47–53 atomic %.

3. An intermetallic compound type alloy according to claim 1, comprising Re 0.05–2 atomic %.

4. An intermetallic compound type alloy according to claim 1, comprising Hf 0.1–2 atomic %.

5. An intermetallic compound type alloy according to claim 1, comprising C 0.05–2 atomic %.

6. An intermetallic compound type alloy according to claim 1, comprising one or more elements selected from a group consisting of Zr, Fe, V, Nb, Ta, Cr, Mo, W and Mn from 0.1–5 atomic %.

7. An intermetallic compound type alloy according to claim 1, comprising one or more elements selected from a group consisting of Zr, Fe, V, Nb, Ta, Cr, Mo, W and Mn from 0.1–3 atomic %.

8. An intermetallic compound type alloy according to claim 1, comprising P, Cu, Zn, Ga, Ge, Cd, In, Sn, Sb, Pb and Bi from 0.1–2 atomic %.

* * * * *

UNITED STATES PATENT AND TRADEMARK OFFICE

CERTIFICATE OF CORRECTION

PATENT NO. : 4,950,340

DATED : August 21, 1990

INVENTOR(S) : Saburo Wakita, et al.

It is certified that error appears in the above-identified patent and that said Letters Patent is hereby corrected as shown below:

Column 1, line 12, change "miscelleneous" to --miscellaneous--.

Column 1, line 26, change "skilful" to --skillful--.

Column 1, line 55, after "45-60%", insert --,-- (comma).

Column 2, line 6, after "Ga," insert --Ge,--.

Column 4, line 2, change "Threrefore" to --Therefore--.

Column 4, Table 1, in the line for "Alloy 22", after "Fe:0.2" insert --,-- (comma).

Column 5, Table 2, in the line for "Alloy 31", after "In:0.04", insert --,-- (comma).

Column 5, Table 2, in the line for "Alloy 35", after "Ta:0.3" insert on the next line --Mo:1.3, Ge:2.9--.

Column 5, Table 3, in the line for "Alloy 49", change "49" to --48--.

Column 5, Table 3, in the line for "Alloy 48", change "48" to --49--.

Column 7, line 36, change "20%" to --20--.

UNITED STATES PATENT AND TRADEMARK OFFICE

CERTIFICATE OF CORRECTION

PATENT NO. : 4,950,340

DATED : August 21, 1990

INVENTOR(S) : Saburo Wakita, et al.

It is certified that error appears in the above-identified patent and that said Letters Patent is hereby corrected as shown below:

Column 8, line 42, change "alloys" to --alloy--.

Column 9, line 67, after "of", second occurrence, delete "the".

Column 13, line 2, change "No." to --Nos.--.

Signed and Sealed this

Sixteenth Day of June, 1992

*Attest:*

DOUGLAS B. COMER

*Attesting Officer*

*Acting Commissioner of Patents and Trademarks*